US010129959B2

(12) United States Patent
Luo

(10) Patent No.: US 10,129,959 B2
(45) **Date of Patent: *Nov. 13, 2018**

(54) LIGHT APPARATUS BASED ON POWER SUPPLY LINE EDGE SIGNALS

(71) Applicant: Xiaohua Luo, Hangzhou (CN)

(72) Inventor: Xiaohua Luo, Hangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/613,158

(22) Filed: Jun. 3, 2017

(65) Prior Publication Data

US 2017/0273163 A1 Sep. 21, 2017

Related U.S. Application Data

(63) Continuation of application No. PCT/CN2015/094957, filed on Nov. 18, 2015.

(30) Foreign Application Priority Data

Dec. 15, 2014 (CN) ..... 2014 1 0775449

(51) Int. Cl.
*H05B 37/02* (2006.01)
*H05B 33/08* (2006.01)

(52) U.S. Cl.
CPC ..... *H05B 37/0263* (2013.01); *H05B 33/0815* (2013.01); *H05B 33/0827* (2013.01); *H05B 33/0845* (2013.01); *H05B 33/0857* (2013.01); *H05B 37/02* (2013.01); *H05B 37/029* (2013.01)

(58) Field of Classification Search
CPC ..... H05B 37/0263; H05B 33/0815; H05B 33/0845; H05B 33/0857
See application file for complete search history.

(56) References Cited

U.S. PATENT DOCUMENTS 5,008,595 A * 4/1991 Kazar ..... H05B 33/0803 315/178
9,723,679 B2 * 8/2017 Luo ..... H05B 33/0857
2007/0285918 A1 * 12/2007 Sloan ..... H05B 33/0803 362/231
2011/0163680 A1 * 7/2011 Welten ..... H05B 33/0818 315/186
2012/0187845 A1 * 7/2012 Saes ..... H05B 33/0818 315/113
2012/0269520 A1 * 10/2012 Hong ..... H01L 25/167 398/172

* cited by examiner

*Primary Examiner* — Dedei K Hammond
*Assistant Examiner* — Raymond R Chai
(74) *Attorney, Agent, or Firm* — Syncoda LLC; Feng Ma; Junjie Feng

(57) ABSTRACT

A colorful light apparatus controlled by input edge signals from a power supply line includes a plurality of LED group, an edge signal generator configured to generate edge signals and output edge signals to the power supply line, and LED drivers configured to drive LED groups based on the edge signals from the power supply line corresponding to each LED group. The edge signal is generated by the controllable switch switching between on and off based on output signals of a control circuit, and is carried to the power supply line. The LED modules are configured to be driven to obtain a plurality of lighting modes, wherein each LED module and its drivers can be connected to the power supply line directly. The structures of the circuits are simple and of low cost. Moreover, various effects of decorations can be achieved by programming using a Microprocessor Control Unit (MCU).

19 Claims, 7 Drawing Sheets

LIGHT APPARATUS BASED ON POWER SUPPLY LINE EDGE SIGNALS

CROSS-REFERENCE TO RELATED APPLICATIONS

The present application is a continuation of, and claims priority to, PCT Application No. PCT/CN2015/094957 filed on Nov. 18, 2015, which in turn claims priority to Chinese Patent Application No. CN 201410775449.5 filed on Dec. 15, 2014. The disclosures of these applications are hereby incorporated by reference in their entirety.

BACKGROUND

Light-Emitting Diodes (LED) can have advantages such as: power-efficient, orientation-controllable, color-display-stable, high reliability, long service life, small sizes, and environmental safety, etc. As such, LEDs are particularly suitable for LED colorful light-emitting apparatus, such as colorful lanterns, decoration lights, etc. A colorful light-emitting apparatus can have multiple LEDs wired in either series or parallel. There is a strong demand for LED lights for holiday decorations such as Christmas, and in applications such as celebrations, entertainment, and night scenery.

LED lights can be in a steady mode, or a flicker mode. LEDs in a steady mode are easier to manufacture, but with monotonous decoration effects. Those methods to manufacture LED lighting strings in flicker mode include: LED flashbulbs are installed among steady mode LEDs with fixed mode and without any change modes controlled by signals; LED lights are divided into several groups controlled by the controller for each group. To make the LED lighting strings work like water flowing, it must be adapted for over 3-channels structure, and the more channels the better the effect of lighting.

The mode to divide an LED lighting string into several LED groups needs to connect those LEDs which lighting at same time in series, and then to connect each group in parallel. The more channels of the LED colorful light is used with more complex structure, more electric wire, more manufacturing difficulty, and higher cost, also with larger size, various parts, and high cost of products.

Chinese invention patent CN1423515 discloses a variable colorful light band for decorating, which comprises a controller to provide trigger voltage and several variable color switch circuits. Each variable color switch circuit comprises two bidirectional controllable silicon which connecting with rectifier diode in series and then connecting with the third bidirectional controllable silicon in parallel. The controlling ports of three bidirectional controllable silicon are connected with the controller. One port of the parallel circuit connects the power and another port connects a plurality of variable colorful LED bulbs. The solution adopts a simple method by controllable silicon circuits to change three colors. But when need to controlling more various colorful mode, the circuit is very complex.

Chinese utility model patent CN203206544U discloses a double-wire LED lighting string with two sets of LED lamps flashing circularly. The double-wire LED lighting string comprises wires and a plurality of LED lamps. All LED lamps are connected in parallel by two wires in the order of that the anode of an LED lamp is connect with the cathode of the next LED lamp, and the cathode of the LED lamp is connected with the anode of the next LED lamp circularly. One wire connected in parallel connect to the first output of a control unit electrically, while the other wire connected in parallel connect to the second output of the control unit. The positive and negative polarities of the first output and the second output of the control unit are interchanged intermittently. It just needs two output wires of the control system, and needs two wires to realize two loop channels of the LED lighting string. In this way, lots of wires are saved, but only achieving two kind of color.

Chinese invention patent CN103528014A discloses an LED Christmas lantern controlled by an IC chip. The LED Christmas lantern comprises a transformer, a controller, an always-on LED lighting channel and a controllable LED lighting channel. The point by point control of the controllable LED lighting channel can be got by the IC control module without any special LED lamp, thus a rich variation of light effects of the controllable LED lighting string is achieved. The scheme requires two separate channel, which are always-on LED lighting channel and controllable LED lighting channel. The IC chip of controllable LED lighting channel needs to connect individually.

Chinese invention patent CN101598277 discloses an LED lighting string using only two wires, which the input port of a coding controller is connected to a power, the output port of the coding controller is connected with two wires, a plurality of LEDs are connected in parallel by the wires to form a multi-channel LED lighting string. Each chip identified by a same number within the same lighting channel is built in the LEDs, while the identified numbers are different in the different lighting channel. The coding controller is connected to transmission circuits via the output port of carrier circuits. The output port of pulse receiving circuit is connected to decoding circuit. The LEDs in different channels with different identified chips brings two disadvantages, one that the coding identifying chip requires read-only memory (ROM) to store code with the higher complexity of coding identifying chip, the other is that the products need to assemble by different identifying codes during the manufacture. If the identified chips are assembly at wrong position, the effect of decoration can't achieve to the expected. This consults in the complexity to assemble final productions.

SUMMARY

To solve the problems in current technologies mentioned above, some embodiments disclosed herein provide a colorful light apparatus based on edge signals from power supply line.

A colorful light apparatus based on edge signals from power supply line comprises:

an edge signal generator configured to generate edge signals and output the edge signals to a power supply line;

a plurality of LED modules, where each LED module comprises an LED group and an LED driver to drive the LED group based on the edge signals from the power supply line.

The number of LED modules in the colorful light apparatus, or the number of LEDs in each LED module could be selected according to the application requirements. Each LED module can be connected in series or in parallel when the number of LED modules are equal to two or larger than two.

The edge signals are generated and output to the power supply line by the edge signal generator. As such, power is supplied from the power supply line for the LED drivers on one hand, the edge signals used as control signals for the LED drivers are carried from the power supply line on the other hand. In the field of LED colorful lights with a number of LEDs, the effects, such as flashing, colors jump, colors brightening gradually, colors darkening gradually and water flowing, could be achieved only using a power supply line and a ground line. This greatly reduces connection wires.

The edge signal generator comprises a controllable switch and control circuit connected to the control port of the controllable switch. The input port of the controllable switch connects to a current source, and the output port of the controllable switch connects to the power supply line.

The edge signal is generated by the controllable switch switching between on and off via the output signal of control circuit, and is carried to the power supply line. The edge signal is at a high voltage level when the controllable switch is on, the edge signal is at a low voltage level when the controllable switch is off.

In some embodiments, the control circuit is implemented based on Microprocessor Control Unit (MCU). To further reduce cost, in some embodiments, a single chip microcomputer (SCM) is selected as the MCU.

To ensure the high response speed of the controllable switch, the field effect transistor is used as the controllable switch. In some embodiments, the controllable switch is implemented by a P-channel field effect transistor.

In some embodiments, the output port of the controllable switch is connected to a pull-down circuit. Via the pull-down circuit, the voltage level of the edge signal from the power supply line is pulled down quickly when the controllable switch is off.

In some embodiments, the LED driver comprises:

an edge-triggered computing unit configured to be triggered to perform computing by the edge signals from the power supply line, and configured to output computing results;

a charging unit configured to supply power to the edge-triggered computing unit based on the edge signals from the power supply line, where the charging unit is charged when the edge signal from the power supply line is at a high voltage, and the charging unit is discharged when the edge signal from the power supply line is at a low voltage;

an initialization unit configured to initialize the edge-triggered computing unit based on the voltage of the power supplied by the charging unit.

A divider resistor is connected between the power supply line and the ground line of the LED driver. The divider resistor is used to divide voltage when LED modules are connected in series.

In some embodiments, the edge-triggered computing unit does counting, arithmetic, logic or bit shift operations, or any other combinations of counting, arithmetic, logic or bit shift operations triggered by the edge signals. The results of the edge-triggered computing unit are used to generate the signals to drive LEDs.

When the number of the LED modules is over two, the edge-triggered computing unit built in the LED driver of each LED module may perform computation in same mode or in different mode.

In some embodiments, the edge-triggered computing unit is configured to perform arithmetic or logic computations triggered by edge signals from the power supply line and to output the computing results. The edge-triggered computing unit comprises n flip-flops and one k-bit arithmetic and logic unit, and outputs the computing results via the outputs of the n flip-flops. In some embodiments, the flip-flops are D flip-flops.

In some embodiments, the edge-triggered computing unit comprises n D flip-flops connected in parallel and one k-bit arithmetic and logic unit, n and k are integers, and n equals k in value, and the computational results are output via the outputs of the n D flip-flops, among which:

the D inputs of the n D flip-flops are connected to the outputs of the arithmetic and logic unit, one to one and bit to bit, low bit to low bit and high bit to high bit;

the reset inputs of the n D flip-flops are connected to the initialization unit, and the clock inputs are connected to the power supply line;

the group A inputs of the arithmetic and logic unit are connected to the Q outputs of the n D flip-flops, bit to bit, low bit to low bit and high bit to high bit, and the group B inputs are configured to receive an external pattern control parameter.

The arithmetic and logic unit is the logic circuit to perform arithmetic or logic operations. The two operands of the arithmetic and logic unit are from the group A inputs and the group B inputs. The output of the arithmetic and logic unit is the result of arithmetic or logic computing of the operands from the group A inputs and the group B inputs.

The arithmetic and logic unit according to some embodiments of the present disclosure can be an adder circuit, a subtractor circuit, a logic computing circuit, a multiplier circuit, or a divider circuit, or any combination of these circuits. When in application, the external pattern control parameter can either have a fixed value, or have several optional potential values which are to be selected by the use of an external pattern-selection circuit, which sets the value of the group B inputs of the edge-triggered computing unit. The user sets the value of the external pattern control parameter as required by external pattern-selection circuit and makes the whole unit compute in various patterns. By way of an example, the arithmetic and logic unit is an adder circuit, and the value of the external pattern control parameter is $2^m$, where m is an integer no less than 0 and less than n. When m equals 0, the external pattern control parameter equals $2^0$, and the edge-triggered computing unit counts by adding 1 for each step; when m equals 1, the external pattern control parameter equals $2^1$, and the edge-triggered computing unit counts by adding 2 for each step, meaning the lowest bit in the computing result (in binaries) stays fixed; when m equals 2, the external pattern control parameter equals $2^2$, and the edge-triggered computing unit counts by adding 4 for each step, meaning the lowest two bits in the computing result (in binaries) stay fixed.

In some embodiments, in the case the arithmetic and logic unit is an adder circuit, the value of the external pattern control parameter can also be set to be $2^n-2^m$, where m is an integer no less than 0 and less than n. For example, when m equals 0, the external pattern control parameter equals to $2^n-1$, the arithmetic and logic unit counts by adding the −1 complement of $2^n$, and the edge-triggered computing unit counts by subtracting 1 for each step; when m equals 1, the external pattern control parameter equals to $2^n-2$, the arithmetic and logic unit counts by adding the −2 complement of $2^n$, and the edge-triggered computing unit counts by subtracting 2 each step, meaning the lowest bit in the computing result (in binaries) stays fixed; when m equals 2, the external pattern control parameter equals to $2^n-4$, the arithmetic and logic unit counts by adding the −4 complement of $2^n$, and the edge-triggered computing unit counts by subtracting 4 each step, meaning the lowest two bits in the computing result (in binaries) stay fixed.

By introducing the external pattern control parameter, various optional computing patterns can be achieved, making the control of LED colorful lights more flexible, and have a more competitive edge in the field of colorful LED lights control.

Unless when specifically claimed to be otherwise, the outputs of the edge-triggered computing unit according to some embodiments of the present disclosure include high bit and low bit outputs. "The first D flip-flop" refers to the D flip-flop that relates to the lowest bit output of the edge-triggered computing unit. And between two adjacent D flip-flops, the one that relates to the lower bit of the edge-triggered computing unit is called the preceding flip-flop, and the one that relates to the higher bit is called the next flip-flop. Accordingly, the group A inputs and the group B inputs of the arithmetic and logic unit also comprise high bit inputs and low bit inputs.

In some embodiments, the edge-triggered computing unit is an edge counting unit. The edge counting unit is configured to count edges of the edge signals from the power supply line, and outputs the counting results.

The edge counting unit comprises a plurality of flip-flops connected in series, and outputs the counting results via the outputs of the plurality of flip-flops.

In some embodiments, the flip-flops are the D flip-flops.

In some embodiments, the edge counting unit comprises a plurality of D flip-flops connected in series, and is configured to output the counting results via the outputs of the D flip-flops, among which:

the clock input of the first D flip-flop is connected to the power supply line, and the clock input of a D flip-flop is connected to the QB output of its preceding D flip-flop among two adjacent D flip-flops;

the reset input of each D flip-flop is connected to the initialization unit, and for each D flip-flop its QB output is connected to its D input.

Unless when specifically claimed to be otherwise, the term "the first D flip-flop" used according to some embodiments of the present disclosure refers to the D flip-flop which relates to the lowest bit of the edge counting unit. And between two adjacent D flip-flops, "the preceding" refers to the one that relates to the lower bit of the edge counting unit, and "the latter" refers to the one corresponding to the higher bit of the edge counting unit.

In some embodiments, the edge-triggered computing unit is an edge-triggered shift unit, configured to shift bits triggered by the edge signals from the power supply line, and to output the results of shifting.

The edge-triggered shift unit comprises at least two flip-flops and outputs the results of the shift operation via the outputs of the at least two flip-flops. In some embodiments, the flip-flops are D flip-flops.

In some embodiments, edge-triggered shift unit comprises at least two D flip-flops connected in series, and outputs shift results of the shift operation via the outputs of the at least two D flip-flops, among which:

the D input of the first D flip-flop is connected to the Q output of the last D flip-flop, the D input of the remaining D flip-flops is connected to the Q output of its preceding D flip-flop among two adjacent D flip-flops;

the reset inputs or the set inputs of each D flip-flops are connected to the initialization unit, and the clock inputs of all of the D flip-flops are connected to the power supply line.

The edge-triggered shift unit according to some embodiments of the present disclosure can be set to any value by initialization, according to different requirements. It only makes sense that at the start point the outputs of the D flip-flops are not identical, otherwise the shifting operation will be meaningless, so the edge-triggered shift unit should have at least one D flip-flop whose reset input is connected to the initialization unit, and one D flip-flop whose set input is connected to the initialization unit. To set a D flip-flop to 0, its reset input should be connected to the initialization unit, and its set input should be connected to the invalid voltage level (if the low voltage level is valid, then its set input should be connected to the high voltage level); likewise, to set a D flip-flop to 1, its set input should be connected to the initialization unit, and its reset input should be connected to the invalid voltage level. When the edge signal from the power supply line is at or beyond the high voltage level, the charging unit charges, and when the voltage of the power supplied by the charging unit reaches the high level, the edge-triggered shifting unit and the initialization unit are power-on.

Unless when specifically claimed to be otherwise, the outputs of the edge-triggered computing unit according to some embodiments of the present disclosure include high bit and low bit outputs. "The first D flip-flop" refers to the D flip-flop that relates to the lowest bit output of the edge-triggered computing unit. And between two adjacent D flip-flops, the one that relates to the lower bit of the edge-triggered computing unit is referred as the preceding D flip-flop, and the one that relates to the higher bit is referred as the next D flip-flop. Accordingly, the group A inputs and the group B inputs of the arithmetic and logic unit also comprise high bit inputs and low bit inputs.

The D flip-flop is a basic circuit used as sequential circuit which comprises a positive output Q and a reverse output QB. The reverse output QB shows the inversion of the positive output Q. The positive output Q is clear to '0' when the reset input of D flip-flop is at valid voltage level. The positive output Q is set to '1' when the set input of D flip-flop is at valid voltage level. The positive output Q is set to its D input whenever its clock input makes a certain transition and its reset input and clear input are both at valid voltage level, otherwise the positive output Q do not change.

The flip-flops can either be rising edge triggered flip-flops, or be falling edge triggered flip-flops, optional to meet specific requirements.

The more the number of the flip-flops are, the wider the computing range of the edge-triggered computing unit is. In some embodiments, the edge-triggered computing unit comprises at least two D flip-flops. More preferably, the edge-triggered computing unit comprises ~200 flip-flops, n is set to be 2~200.

The charging unit comprises a unidirectional conduction component, which conducts when its anode voltage is higher than its cathode voltage, and shuts off when its cathode voltage is higher than its anode voltage. The anode of the unidirectional conduction component is connected to the power supply line, and its cathode is connected to ground via a power storage component, and via the cathode the charging unit supplies power to the edge-triggered computing unit and the initialization unit. The unidirectional conduction component can be one device, or a unidirectional conduction circuit comprising several devices.

The LED group comprises n LEDs, and the connection type of the LED group is one of A(n,n) permutations connection types corresponding to the n output ports of the LED driver. The anodes of n LEDs connect to the power input port of the LED module, and the cathodes of n different color LEDs connect to n output port of the LED driver respectively.

The cathodes of n LEDs in the LED group connect to the corresponding n output ports of the LED driver. The computing results of the edge-triggered computing unit in the LED driver triggered by edge signals from the power supply line range from 0 to $(2^n-1)$. Each LED group can achieve $2^n$ optional patterns controlled by the edge signals from the power supply line. More preferably, via setting the keeping time of high voltage level after the edge signal, the lighting patterns corresponding to the keeping time can be further achieved.

More preferably, those values, $K_0, K_1, \ldots, K_u$ (u is an integer more than 0), are chosen from the computing results $0\sim(2^n-1)$, and the corresponding keeping time of high voltage level, $D_0, D_1, \ldots, D_u$, is set. The color pattern set corresponding to the computing results is $\{L_0, L_1, \ldots, L_u\}$. Several edge signals are sent to make the computing results of the LED driver equal to $K_0$ in the short time that can't be distinguished by human eyes, and high voltage level are keeping in the time $D_0$; several edge signals are sent to make the computing result of the LED driver equal to $K_1$ in the short time that can't be distinguished by human eyes, and high voltage level are keeping in the time $D_1$; other computing results and the time to keep high voltage are made in same mode; several edge signals are sent to make the computing result of the LED driver equal to $K_u$ in the short time that can't be distinguished by human eyes, and high voltage level are keeping in the time $D_u$. Thus, the color mode of LED group could set to jump corresponding to the computing results $K_0, K_1, \ldots, K_u$. More preferably, the jump speed of color mode could be set corresponding to the high voltage keeping times $D_0, D_1, \ldots, D_u$.

More preferably, the color patterns of LED groups can realize the effect of water flowing in visual, when the first LED group changed as $L_0 \rightarrow L_1 \rightarrow \ldots \rightarrow L_u$, the second LED group changed as $L_1 \rightarrow L_2 \rightarrow \ldots \rightarrow L_u \rightarrow L_0$, the third LED group changed as $L_2 \rightarrow L_3 \rightarrow \ldots \rightarrow L_u \rightarrow L_0 \rightarrow L_1$, and so on, and then the last LED group changed as $L_u \rightarrow L_0 \rightarrow L_1 \rightarrow \ldots \rightarrow L_{u-1}$. More preferably, the water flowing speed could be set corresponding to the high voltage keeping times $D_0, D_1, \ldots, D_u$ after the edge signals are sent.

In some embodiments, the LED driver also comprises LED driver circuit. The input of the LED driver circuit connects to the output of edge-triggered computing unit, and the outputs of the LED driver circuits connect to the corresponding LEDs to drive those LEDs.

According to some embodiments, power is supplied from the power supply line, and clock signals for the LED drivers are transferred from the power supply line. The clock signals are the edge signals from the power supply line, also are the power edge signals according to some embodiments of the present disclosure. It is not necessary to use clock generation circuits in the embodiments. Therefore, circuit design can be simplified.

In another aspect, a light-emitting system is provided including the light apparatus described above. The system can further include LEDs of various colors, connectors, controllers, one or more processing circuit, etc.

Compared with the current technologies, the edge signals are carried from the power supply line by the controllable switch switching between on and off to control the power supply line on and off in the colorful light. Those led groups are drive to get many different color patterns with each led module and its drivers connected to the power supply line directly according to some embodiments of the present disclosure. This makes the circuit simple and reduces cost. Moreover, various effects of decorations can be achieved by MCU programming.

DETAILED DESCRIPTION

In the following, with reference to the drawings of embodiments disclosed herein, the technical solutions of the embodiments of the disclosure will be described in a clear and fully understandable way.

As illustrated in FIG. 1 and FIGS. 2A-2C, an implemented colorful light apparatus 100 based on edge signals from power supply line comprises:

an edge signal generator configured to generate edge signals and output edge signals to the power supply line;

The edge signal generator in the implementation example comprises a controllable switch 101 and control circuit connected to the control port of the controllable switch. The controllable switch 101 comprises a P channel MOSFET CJ2301. The source of the P channel MOSFET using as input port connects to a current source (+5V current source), the drain of the P channel MOSFET using as output port connects to the power supply line, the gate of the P channel MOSFET using as control port connects to the output of the control circuit. The output port of the controllable switch connects to ground via a pull-down circuit. The pull-down circuit is a pull-down resistance (1 MΩ) 103 with one port connected to the output port of the controllable switch and the other port connected to ground. The edge signal will be pull down quickly when the controllable switch is off.

The control circuit is implemented using MCU 102, which is a single chip microcomputer STC15F104E in the implementation example. Via the control signal output by STC15F104E, the controllable switch is on or off, and in fact the controllable switch conducts or cuts off When the controllable switch conducts, the edge signal from the power supply line is at high voltage level. When the controllable switch cuts off, the edge signal from the power supply line is at low voltage level.

A plurality of LED modules, where each LED module comprises an LED group, and an LED driver to drive the LED group based on the edge signals from the power supply line.

Figure 1:
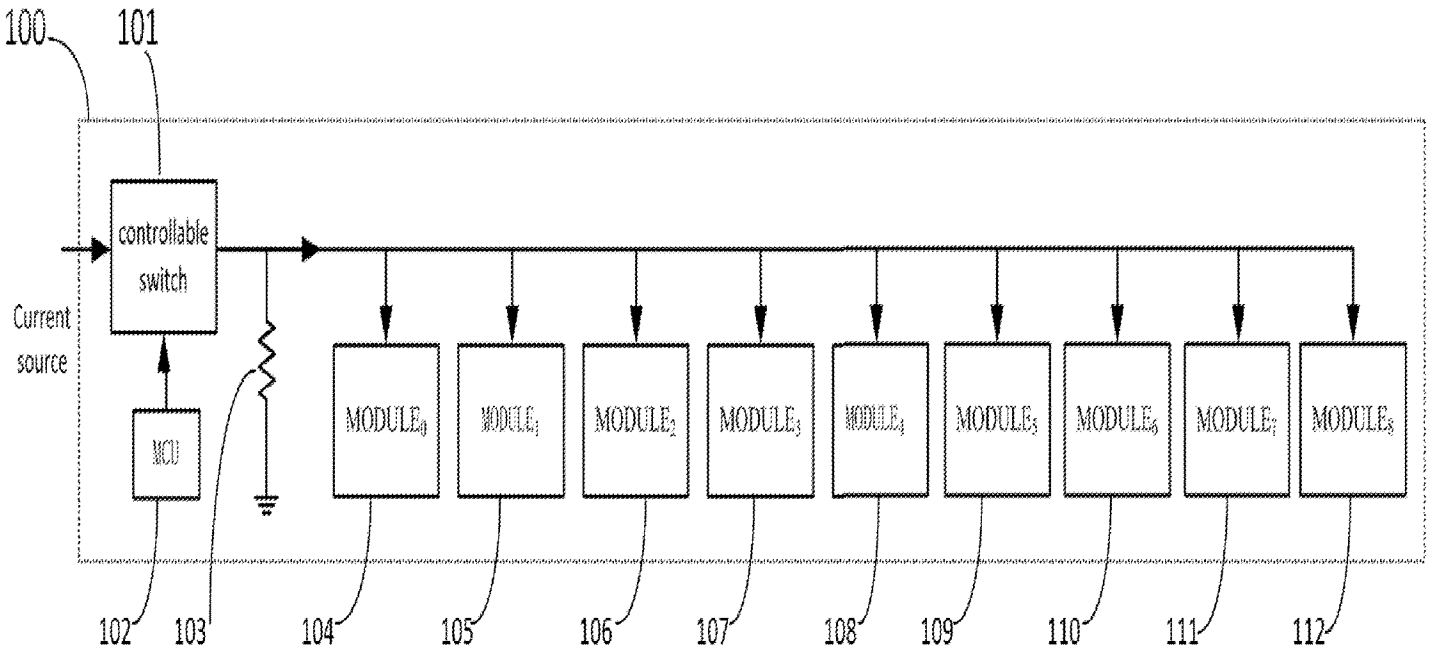
FIG. 1 illustrates a schematic diagram of a colorful light apparatus based on edge signals from a power supply line.
Figures 2A, 2B, 2C:
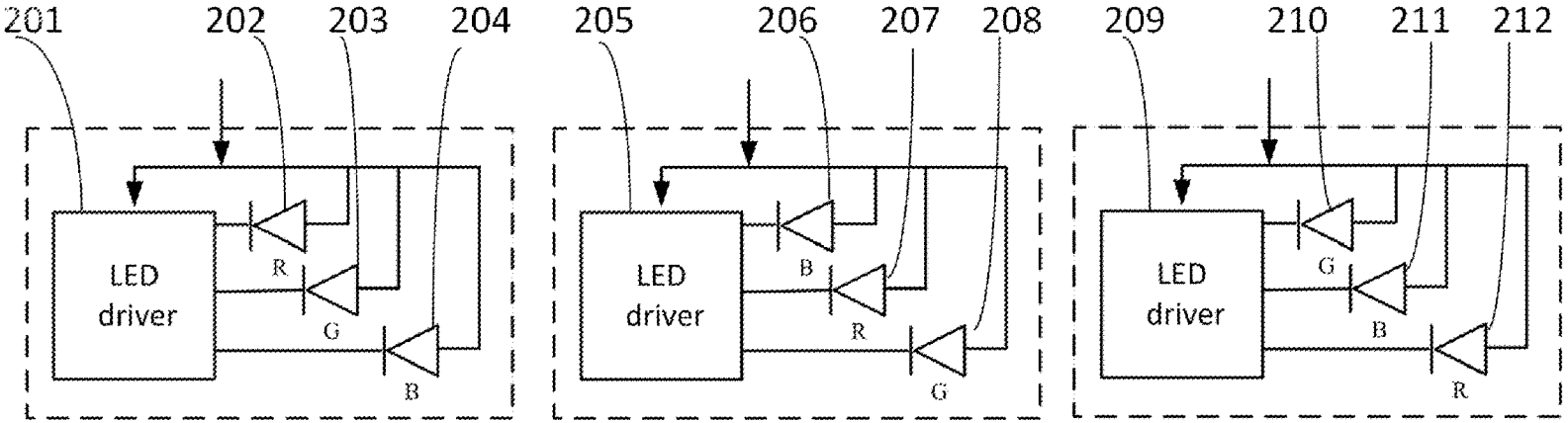
FIG. 2A is an implemented connection diagram of LED modules with a first connection type according to some embodiments.
FIG. 2B is an implemented connection diagram of LED modules with a second connection type according to some embodiments.
FIG. 2C is an implemented connection diagram of LED modules with a third connection type according to some embodiments.

Each LED group comprises three LEDs in different colors, red, green and blue in the implemented example. There are 9 LED modules in the LED colorful light apparatus, which are $MODULE_0$ 104, $MODULE_1$ 105, $MODULE_2$ 106, $MODULE_3$ 107, $MODULE_4$ 108, $MODULE_5$ 109, $MODULE_6$ 110, $MODULE_7$ 111 and $MODULE_8$ 112. The connections of LEDs in LED modules are illustrated in FIGS. 2A, 2B, and 2C: the LED modules, $MODULE_0$, $MODULE_3$ and $MODULE_6$, their outputs of the LED drivers 201 from low bit to high bit are connected to red LED 202 (R in FIGS. 2A, 2B, and 2C), green LED 203 (G in FIGS. 2A, 2B, and 2C) and blue LED 204 (B in FIGS. 2A, 2B, and 2C) respectively in FIG. 2A; the LED modules, $MODULE_1$, $MODULE_4$ and $MODULE_7$, their outputs of the LED drivers 205 from low bit to high bit are connected to blue LED 206, red LED 207 and green LED 208 respectively in FIG. 2B; the LED modules, $MODULE_2$, $MODULE_5$, $MODULE_8$, their outputs of the LED drivers 209 from low bit to high bit are connected to green LED 210, blue LED 211 and red LED 212 respectively in FIG. 2C.

Figure 3:
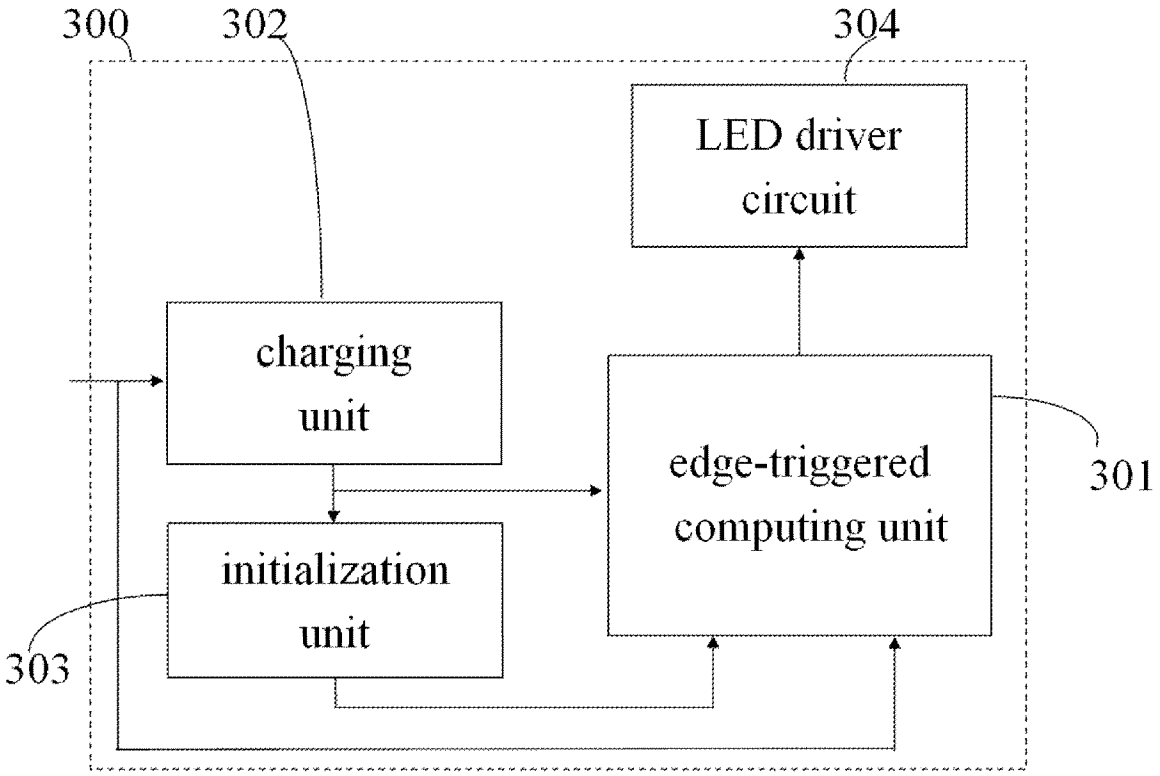
FIG. 3 is an implemented structure diagram of LED driver.
Figure 4:
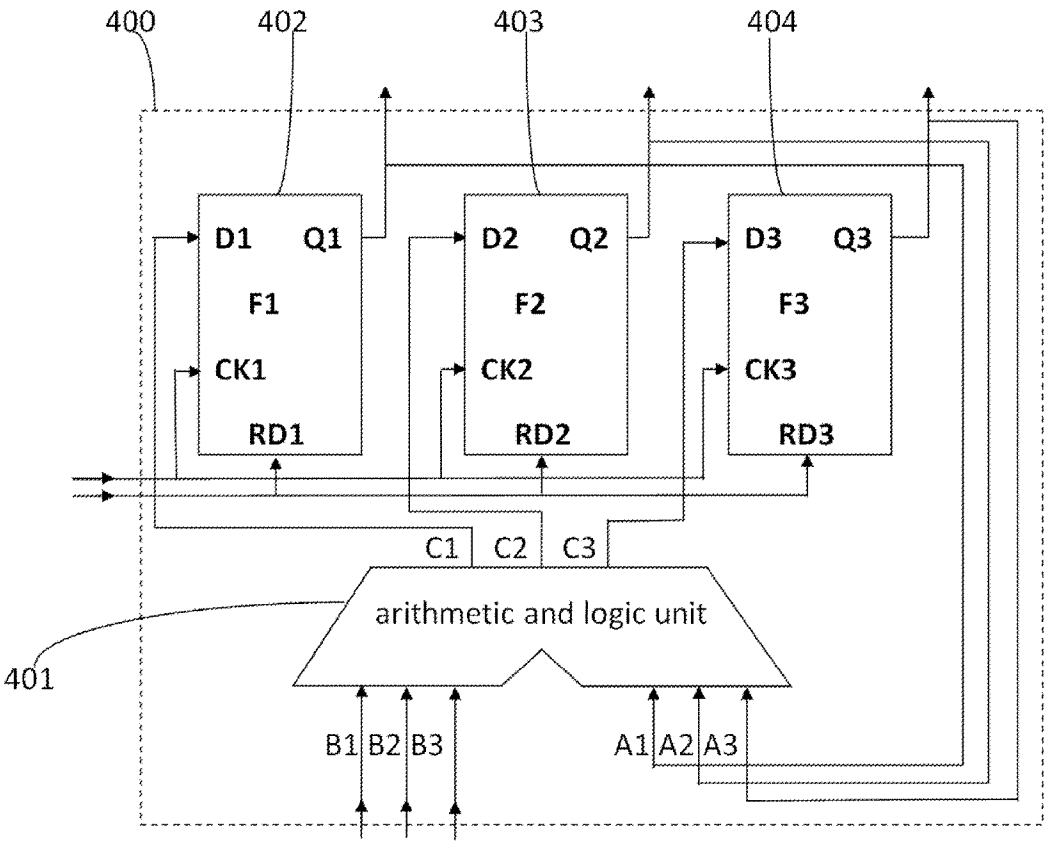
FIG. 4 is an implemented schematic diagram of the edge-triggered computing unit.

As illustrated in FIG. 3, an LED driver 300 in the implementation example comprises:

an edge-triggered computing unit 301, which is configured to triggered to perform computing by the edge signals from power supply line, and is configured to output computing results;

a charging unit 302, which supplies power to the edge-triggered computing unit based on the edge signals from the power supply line; the charging unit is charged when the edge signal from the power supply line is at a high voltage, and is discharged when the edge signal from the power supply line is at a low voltage;

an initialization unit 303, which initializes the edge-triggered computing unit based on the voltage of the power supplied by the charging unit; and an LED driver circuit 304, which outputs the driving signals to drive the corresponding LED group based on the computing results of the edge-triggered computing unit. The implemented LED driver comprises three NMOS transistors, where the gate of each NMOS transistor is connected to the output of the edge-triggered computing unit, the source of each NMOS transistor is connected to the ground of LED driver, the drain of each NMOS transistor is connected to the output of LED driver. The edge-triggered computing unit 400 is illustrated in FIG. 4, which comprises three D flip-flops in parallel and a 3-bit arithmetic and logic unit 401. The output port of each D flip-flop outputs computing results.

In the implementation example, the D flip-flops are positive edge triggered with low voltage asynchronous rest input. There are three D flip-flops, the first flip-flop F1 402, the second flip-flop F2 403 and the third flip-flop F3 404, with their positive outputs Q1, Q2 and Q3. The counting results from low bits to high bits are Q1, Q2 and Q2. The D inputs of D flip-flops are connected to the corresponding outputs of the arithmetic and logic unit, meaning that D1 is connected to C1, D2 is connected to C2, and D3 is connected to C3.

All the reset inputs (meaning RD1, RD2 and RD3) of the D flip-flops are connected to the output of the initialization unit. These D flip-flops are set initial values via the initialization unit.

All the clock inputs (meaning CK1, CK2 and CK3) are connected to the power supply line. The arithmetic computing is triggered to perform arithmetic and logic computing by edge signals from the power supply line.

The edge-triggered computing unit in the implementation example is a 3-bit adder, the group A inputs of the 3-bit adder from low bits to high bits are A1, A2, and A3, the group B inputs of the 3-bit adder from low bits to high bits are B1, B2 and B3, and whose outputs from low bits to high bits are C1, C2 and C3. The group A inputs of the arithmetic and logic unit are connected to the outputs of the D flip-flops bit to related bit correspondingly, meaning Q1 to A1, Q2 to A2, and Q3 to A3. The group B inputs of the 3-bit adder are connected to the external pattern control parameter. The external pattern control parameter can be set to meet customer requirements.

Figure 5:
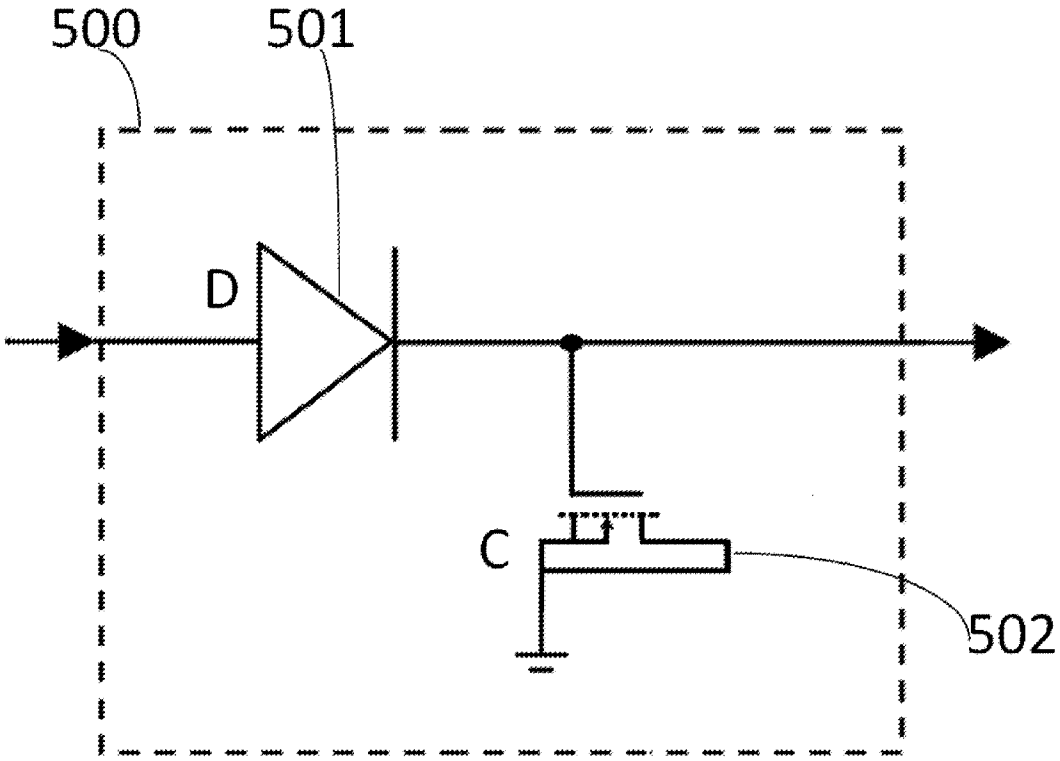
FIG. 5 is an implemented schematic diagram of the charging unit.

FIG. 5 illustrates an implemented circuit of the charging unit 500, which comprises a diode, D 501, whose anode is connected to the power supply line, and whose cathode is connected to ground via a power storage component C 502 (in the implementation example the charging capacitor is an equivalent capacitor formed by connecting the source and drain of a MOSFET, whose capacitance is 0.2 μF). The charging unit supplies power to the edge-triggered computing unit and the initialization unit via the cathode of the diode D.

Figure 6:
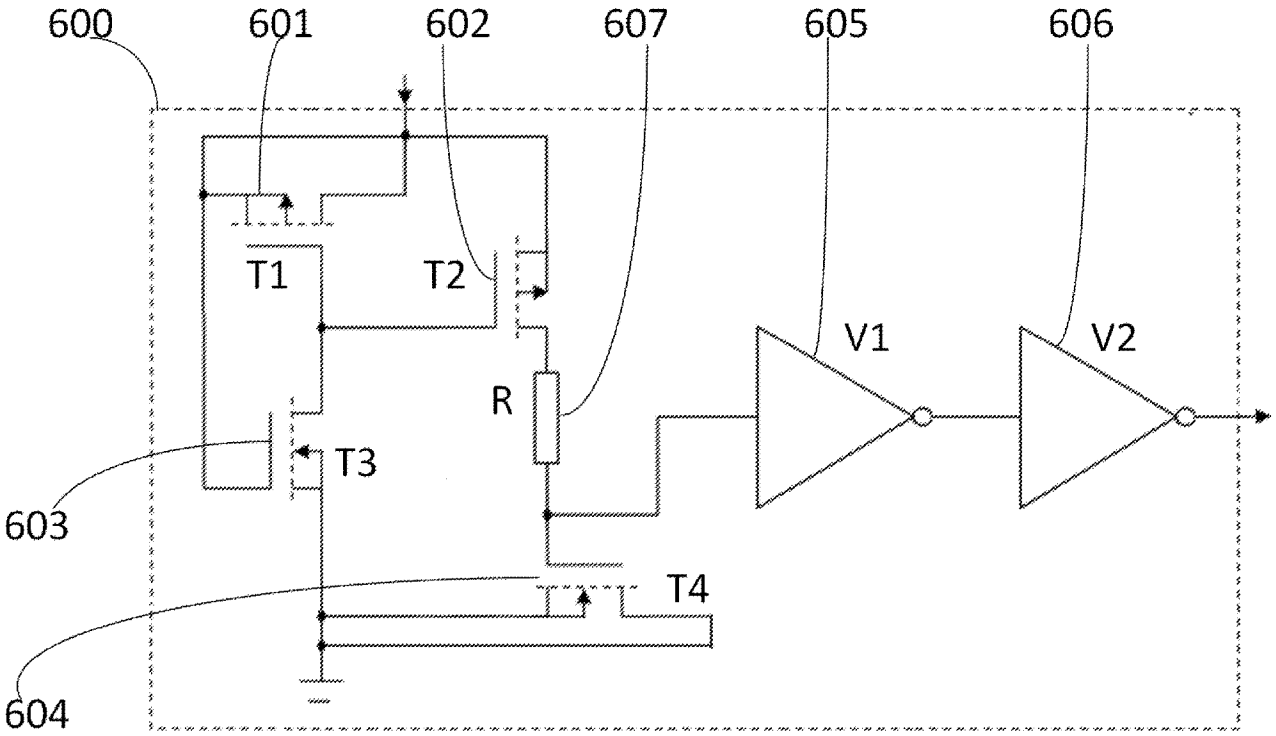
FIG. 6 is an implemented schematic diagram of the initialization unit.

FIG. 6 illustrates an implemented circuit of the initialization unit 600 in the implementation example, which comprises four MOSFETS, including a p-channel MOSFET T1 601, a p-channel MOSFET T2 602, an n-channel MOSFET T3 603, and an n-channel MOSFET T4 604, the first inverter V1 605 and the second inverter V2 606. The connections are followed:

the source and drain of the MOSFET T1 are connected to the cathode of the diode D of the charging unit, and the gate of T1 is connected to the drain of the MOSFET T3, while the gate of the MOSFET T3 is connected to the source of the MOSFET T1, and the source of T3 is connected to ground. The gate and source of the MOSFET T2 are connected respectively to the gate and source of the MOSFET T1, and the drain of T2 is connected to the gate of the MOSFET T4 via a current limiting resistor R 607 in between, whose value is 500Ω, and the drain and the source of T4 are connected respectively to the source of the MOSFET T3 and ground.

the gate of the MOSFET T4 is connected to the input of the first inverter V1, and the output of V1 is connected to the input of the second inverter V2, and the output of V2 is the output of the initialization unit, outputting reset signal to the edge-triggered computing unit.

The working principles of the arithmetic computing apparatus triggered by edge signals from power supply line in the implementation example is followed:

When this apparatus is not powered up, the voltage of the power supplied by the charging unit is at low level, the initialization unit and the edge counting unit are insufficiently powered and the whole apparatus does not count.

When the counting apparatus is power-on, and the edge signal is at the high voltage, the power storage component C in the charging unit is charged. When the high voltage stays long enough, the voltage of the power supplied by the charging unit rises from low to high, so the initialization unit and the edge counting unit are properly powered.

Thus, the MOSFET T3 in the initialization unit is switched on, causing T2 switched on, and the charging unit charges the equivalent capacitor MOSFET T4 via the current limiting resistor R. With the charging going on, the voltage level at the gate of T4 rises, and when it becomes high enough to cause the second inverter V2's output signal to switch from low voltage to high voltage, the initialization process completes.

The output of the second inverter V2 is connected to the reset inputs of the edge counting unit, and when the second inverter V2 outputs low voltage, the D flip-flops are reset, meaning the edge counting unit is cleared to 0.

Figure 7:
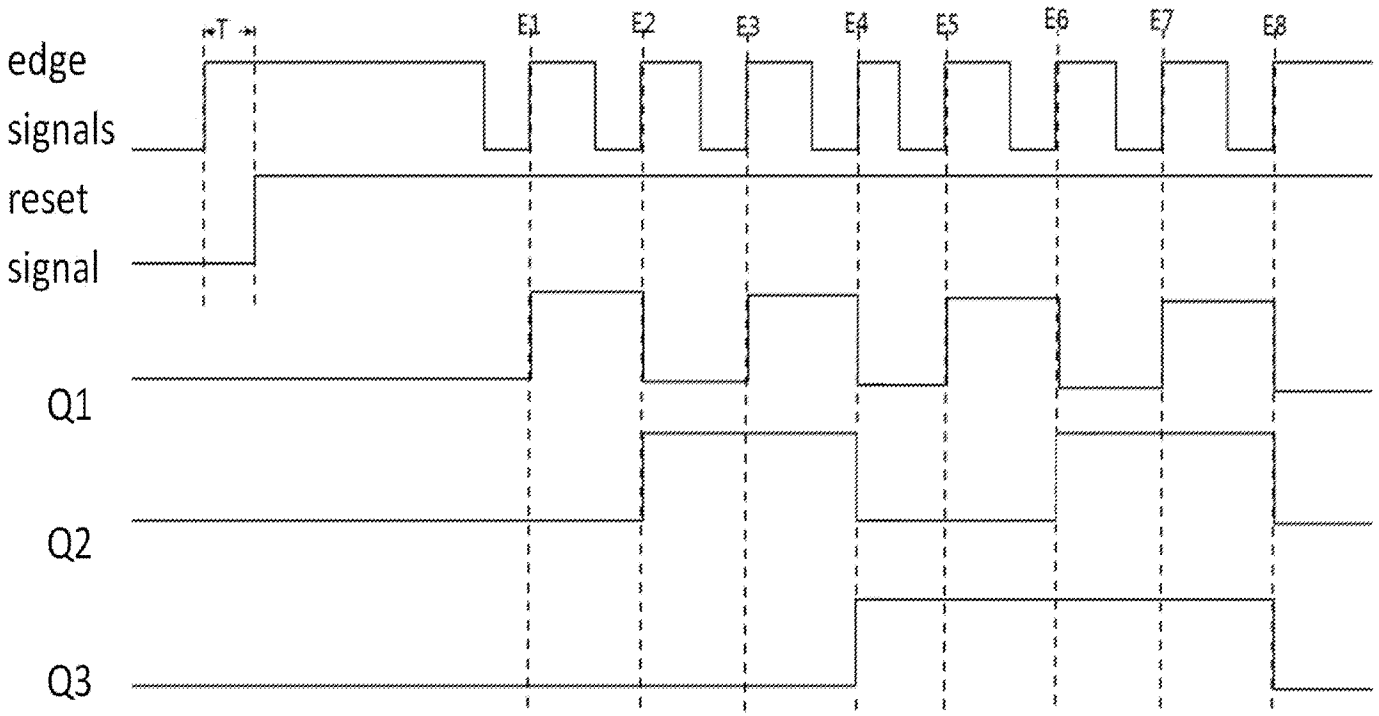
FIG. 7 is the implemented timing diagrams of the edge signals transferred from the power supply line.

FIG. 7 illustrates the timing diagram of the edge signals transferred through the power supply line, the counting results, reset signal outputted by initialization unit in the first implementation example, in which the counting results are represented by the three positive outputs of three D flip-flops. After the power is up, at time T the three D flip-flops are reset to logic 0, meaning the counting result is cleared. At the rising edge E1 of the edge signal from the power supply line, the counting result is 001; and at E2, it is 010; and at E3, it is 011; and at E4, it is 100; and at E5, it is 101; and at E6, it is 110; and at E7, it is 111; and at E8, the counting apparatus overflows, and the counting output is 000. In the LED driver triggered by edge signal from power supply line, the computing result values of edge-triggered computing unit range from 0 to $(2^3-1)$.

After the power is on, at moment T, three D flip-flops are reset to 0, meaning the output of edge-triggered computing unit is 0 and each LED in all LED modules is off. The LEDs work as follows:

at the rising edge E1 of the edge signal with the computing result equal to 001, the red LEDs are lightened in LED modules $MODULE_0$, $MODULE_3$ and $MODULE_6$, the blue LEDs are lightened in LED modules $MODULE_1$, $MODULE_4$ and $MODULE_7$, the green LEDs are lightened in LED modules $MODULE_2$, $MODULE_5$ and $MODULE_8$;

at the rising edge E2 of the edge signal with the computing result equal to 010, the green LEDs are lightened in LED modules $MODULE_0$, $MODULE_3$ and $MODULE_6$, the red LEDs are lightened in LED modules $MODULE_1$, $MODULE_4$ and $MODULE_7$, the blue LEDs are lightened in LED modules $MODULE_2$, $MODULE_5$ and $MODULE_8$;

at the rising edge E3 of the edge signal with the computing result equal to 011, the green LEDs and red LEDs are lightened in LED modules $MODULE_0$, $MODULE_3$ and $MODULE_6$, the red LEDs and blue LEDs are lightened in LED modules $MODULE_1$, $MODULE_4$ and $MODULE_7$, the blue LEDs and green LEDs are lightened in LED modules $MODULE_2$, $MODULE_5$ and $MODULE_8$;

at the rising edge E4 of the edge signal with the computing result equal to 100, the blue LEDs are lightened in LED modules $MODULE_0$, $MODULE_3$ and $MODULE_6$, the green LEDs are lightened in LED modules $MODULE_1$, $MODULE_4$ and $MODULE_7$, the red LEDs are lightened in LED modules $MODULE_2$, $MODULE_5$ and $MODULE_8$;

at the rising edge E5 of the edge signal with the computing result equal to 101, the red LEDs and blue LEDs are lightened in LED modules $MODULE_0$, $MODULE_3$ and $MODULE_6$, the green LEDs and blue LEDs are lightened in LED modules $MODULE_1$, $MODULE_4$ and $MODULE_7$, the red LEDs and green LEDs are lightened in LED modules $MODULE_2$, $MODULE_5$ and $MODULE_8$;

at the rising edge E6 of the edge signal with the computing result equal to 110, the blue LEDs and green LEDs are lightened in LED modules $MODULE_0$, $MODULE_3$ and $MODULE_6$, the green LEDs and red LEDs are lightened in LED modules $MODULE_1$, $MODULE_4$ and $MODULE_7$, the red LEDs and blue LEDs are lightened in LED modules $MODULE_2$, $MODULE_5$ and $MODULE_8$;

at the rising edge E7 of the edge signal with the computing result equal to 111, the red, green and blue LEDs in all LED modules are lightened;

at the rising edge E8 of the edge signal with the computing result equal to 000 for the counting apparatus overflows, the red, green and blue LEDs in all LED modules are darkened.

To control the colorful light in the implemented apparatus, the edge signals are generated and carried to the power supply line via the control circuit in the edge signal generator. Thus, the LEDs are lightened in different modes, and different effects of colorful light are achieved.

The edge signals are carried through the power supply line to make each led group to work in 8 color patterns, such as red, green, blue, red-green, red-blue, green-blue, red-green-blue and all darkened. To achieve 7 colors changes in interval time 1 second, the high voltage level after the rising edge in FIG. 7 is keeping in 1 second. Changing the keeping time of high voltage level after the rising edge in FIG. 7, seven colors jump mode can be set in corresponding speed.

For example, three results 1, 2, and 4 are chosen from the computing results 0~7, and the keeping time of high voltage level is set to 1 second. The corresponding color pattern set is {red, green, blue} in the implemented example. At beginning, the edge-triggered computing unit outputs 0 and three LEDs in $MODULE_0$ are all darkened. As illustrated in FIG. 7, the computing result equals to 1 at the rising edge E1 with the 100 ns low voltage, then the high voltage level is keeping in one second; the computing result equals to 2 at the rising edge E2 with the 100 ns low voltage, then the high voltage level is keeping in one second; the computing result equals to 3 at the rising edge E3 with the 100 ns low voltage, then the high voltage level is keeping in 100 ns; the computing result equals to 4 at the rising edge E4 with the 100 ns low voltage, then the high voltage level is keeping in one second. Via the above method, since human's eyes can't distinguish anything in short time, that means the persistence effect of eyes vision, the implemented color light $MODULE_0$ can achieve red-green-blue jump with one second interval time. More preferably, the jumping speed of three colors can be set corresponding to the keeping time of high voltage after the edge signals.

By the above method, the computing results of LED drivers jumps in the order 1 ➔ 2 ➔ 4. The color patterns of LED modules, $MODULE_0$, $MODULE_3$ and $MODULE_6$, changes in the order red ➔ green ➔ blue; the color patterns of LED modules, $MODULE_1$, $MODULE_4$ and $MODULE_7$, changes in the order blue ➔ red ➔ green; the color patterns of LED modules, $MODULE_2$, $MODULE_5$ and $MODULE_8$, changes in the order green ➔ blue ➔ red. Thus, the whole LED colorful light can realize the effect of water flowing in vision of red, greed, and blue. Via setting the keeping time of high voltage after the edge signals, the corresponding speed of water flowing is achieved. To ensure the initialization unit and the edge-triggered computing unit be properly powered in the whole computing process, the low voltage durations in the edge signals must be shorter than the power storage component C's discharge time during which the output voltage drops from high voltage level to low voltage level.

What's more, due to the unidirectional-conduction feature of the diode, the power storage component will not charge the power supply line with a reverse current when it discharges.

If not specifically claimed, the range of the high voltage described in this implementation example is within 3.0~5V, and the low voltage be less than 1.0V.

In the implementation of the LED driver, only one line is used to transfer both the edge signals and the power. Based on the computation triggered by the edge signals, the LED Driver drives LED colorful light in seven color lighting, in seven color jump and in water flowing, without any extra signal line to transfer the control signal.

The implementation examples have been described above in detail for the technology solution and the effects of some embodiments of the present disclosure. It should be appreciated, therefore, those implementation examples are just preferred embodiments, are not intended as required or essential elements. Any revised, alternative, equivalent or improved solution, is considered in the scope of the claims of the present disclosure and in the scope of protection, including but not restricted to the following examples:

inserting filtering circuits, delay circuits, or inserting inverse circuits between the clock inputs of the D flip-flops and the power supply line, or using an adder circuit or a subtractor circuit as the arithmetic and logic unit ignoring the input group B.

All references cited herein are incorporated by reference in their entirety. Although specific embodiments have been described above in detail, the description is merely for purposes of illustration. It should be appreciated, therefore, that many aspects described above are not intended as required or essential elements unless explicitly stated otherwise. Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A color light apparatus based on edge signals from a power supply line, the apparatus comprising:

an edge signal generator configured to generate the edge signals and output the edge signals to the power supply line;

a plurality of light-emitting diode (LED) modules, wherein each LED module comprises an LED group, and an LED driver to drive the LED group based on the edge signals from the power supply line; wherein each of the LED driver of the plurality of LED modules comprises:

an edge-triggered computing unit configured to be triggered to perform computing by the edge signals from the power supply line, and configured to output computing results;

a charging unit configured to supply power to the edge-triggered computing unit based on the edge signals from the power supply line, wherein the charging unit is charged when the edge signal from the power supply line is at a high voltage, and the charging unit is discharged when the edge signal from the power supply line is at a low voltage;

an initialization unit configured to initialize the edge-triggered computing unit based on the voltage of the power supplied by the charging unit.

2. The apparatus of claim 1, wherein the edge signal generator comprises a controllable switch and a control circuit connected to a control port of the controllable switch, wherein an input port of the controllable switch connects to a current source, and an output port of the controllable switch connects to the power supply line.

3. The apparatus of claim 2, wherein the output port of the controllable switch is connected to a pull-down circuit.

4. The apparatus of claim 1, wherein the edge-triggered computing unit is configured to perform arithmetic or logic computations triggered by the edge signals from the power supply line, and to output computing results.

5. The apparatus of claim 4, wherein the edge-triggered computing unit comprises n flip-flops, and one k-bit arithmetic and logic unit, and outputs the computing results via the outputs of the flip-flops, wherein n and k are positive integers.

6. The apparatus of claim 5, wherein the n flip-flops are D flip-flops.

7. The apparatus of claim 6, wherein the edge-triggered computing unit comprises n D flip-flops connected in parallel, and one k-bit arithmetic and logic unit, wherein values of n and k are equal, and the edge-triggered computing unit outputs the computing results via the outputs of the n flip-flops, wherein:

D inputs of the n D flip-flops are connected to the outputs of the arithmetic and logic unit, one to one and bit to bit, low bit to low bit and high bit to high bit;

reset inputs of the n D flip-flops are connected to the initialization unit;

clock inputs are connected to the power supply line;

group A inputs of the k-bit arithmetic and logic unit are connected to Q outputs of the D flip-flops; and group B inputs of the k-bit arithmetic and logic unit are configured to external pattern control parameter.

8. The apparatus of claim 1, wherein the edge-triggered computing unit is an edge counting unit configured to count a number of edges of the edge signals from the power supply line, and to output a counting result.

9. The apparatus of claim 8, wherein the edge counting unit comprises a plurality of flip-flops, and outputs the counting results via the outputs of the plurality of flip-flops.

10. The apparatus of claim 9, wherein the plurality of flip-flops are D flip-flops.

11. The apparatus of claim 10, wherein the plurality of D flip-flops are connected in series, and the counting results are output via the outputs of the D flip-flops.

12. The apparatus of claim 1, wherein the edge-triggered computing unit is an edge-triggered shift unit, configured to shift signal bits triggered by the edge signals from the power supply line, and to output results of shifting.

13. The apparatus of claim 12, wherein the edge-triggered shift unit comprises at least two flip-flops and outputs the results of shifting via the outputs of the flip-flops.

14. The apparatus of claim 13, wherein the edge-triggered shift unit comprises at least two D flip-flops connected in series and outputs the results of the shift operation via the outputs of the D flip-flops.

15. The apparatus of claim 1, wherein:

the charging unit comprises a unidirectional conduction component; an anode of the unidirectional conduction component is connected to the power supply line; a cathode of the unidirectional conduction component is connected to ground via a power storage component; the charging unit supplies power to the edge-triggered computing unit and the initialization unit via the cathode.

16. The apparatus of claim 15, wherein:

each of the plurality of LED modules comprises n LEDs corresponding to n outputs of each of the LED driver.

17. The apparatus of claim 16, wherein:

each of the LED driver comprises an LED driver circuit;

an input of the LED driver circuit connects to the output of edge-triggered computing unit, and an output of the LED driver circuit connects to and drives corresponding LEDs.

18. A light-emitting system comprising:

a color light apparatus configured to be controlled by edge signals from a power supply line, the color apparatus comprising:

an edge signal generator configured to generate the edge signals and output the edge signals to the power supply line; and a plurality of light-emitting diode (LED) modules having a plurality of colors, where each LED module comprises:

an LED group; and an LED driver configured to drive the LED group based on the edge signals from the power supply line; wherein each of the LED driver of the plurality of LED modules comprises:

an edge-triggered computing unit configured to be triggered to perform computing by the edge signals from the power supply line, and configured to output computing results;

a charging unit configured to supply power to the edge-triggered computing unit based on the edge signals from the power supply line, wherein the charging unit is charged when the edge signal from the power supply line is at a high voltage, and the charging unit is discharged when the edge signal from the power supply line is at a low voltage;

an initialization unit configured to initialize the edge-triggered computing unit based on the voltage of the power supplied by the charging unit.

19. The system of claim 18, wherein the edge signal generator comprises a controllable switch and a control circuit connected to a control port of the controllable switch, wherein an input port of the controllable switch connects to a current source, and an output port of the controllable switch connects to the power supply line.

* * * * *